United States Patent [19]

Granger et al.

[11] 3,981,215

[45] Sept. 21, 1976

[54] APPARATUS FOR CUTTING SHEET MATERIAL

[76] Inventors: Maurice Granger, 28 rue Charles de Gaulle, 42000 Saint-Etienne, Loire; Andre Lerond, 174 rue Leon Blum, 69100 Villeurbanne, Rhone; Olivier Failliot, Rochefort en Yvelines, Yvelines, all of France

[22] Filed: Oct. 9, 1974

[21] Appl. No.: 513,495

[30] Foreign Application Priority Data

Oct. 12, 1973 France ..... 73.37147
Feb. 12, 1974 France ..... 74.05637

[52] U.S. Cl. ..... 83/455; 83/485; 83/508; 83/508.2; 83/522; 83/588; 83/614; 83/649; 83/651.1; 83/658; 83/701

[51] Int. Cl.[2] ..... B26D 1/20

[58] Field of Search ..... 83/614, 522, 455, 487, 83/485, 651.1, 510, 508, 649, 588, 508.2, 658, 701

[56] References Cited

UNITED STATES PATENTS

| | | | |
|---|---|---|---|
| 879,153 | 2/1908 | Dirr et al. | 83/485 |
| 2,599,601 | 6/1952 | Axworthy | 83/485 |
| 3,137,192 | 6/1964 | McNeill | 83/455 |
| 3,447,409 | 6/1969 | Lewis | 83/614 X |
| 3,605,537 | 9/1971 | Pickler | 83/614 X |
| 3,659,487 | 5/1972 | Henderson | 83/485 X |
| 3,686,991 | 8/1972 | Fujimoto | 83/614 X |

*Primary Examiner*—Frank T. Yost
*Attorney, Agent, or Firm*—Haseltine, Lake & Waters

[57] ABSTRACT

Apparatus for cutting sheet material unwound from a roll supported adjacent a cutter, the cutter comprising a stationary cutting member and a distinct movable cutting member adapted to cut material placed between the cutting members. The stationary cutting member is mounted on a support which can be affixed to a wall or supported on legs on the floor, and the movable cutting member is guidably supported for longitudinal travel along the stationary cutting member on which it rides to effect cutting of the material.

15 Claims, 23 Drawing Figures

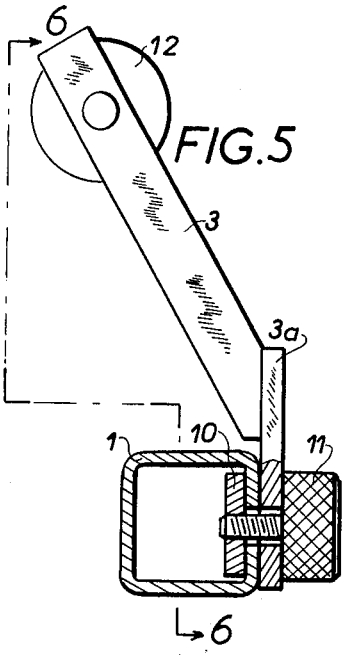
FIG.5
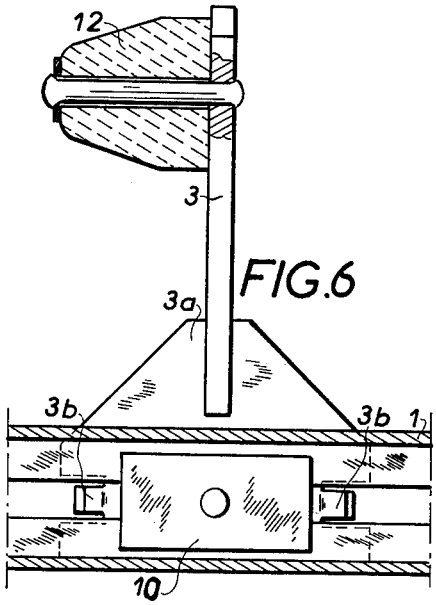
FIG.6
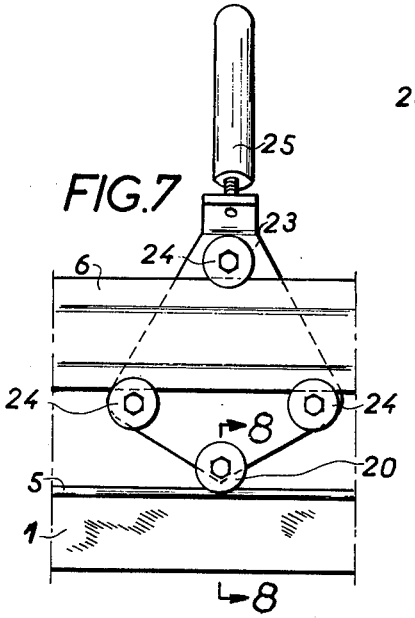
FIG.7
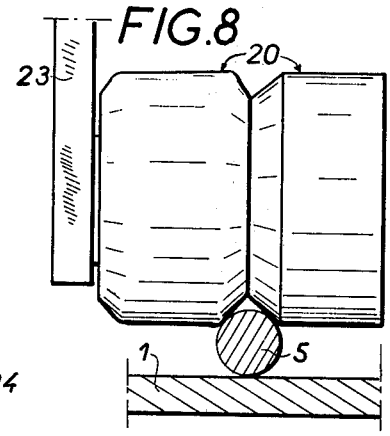
FIG.8
FIG.9
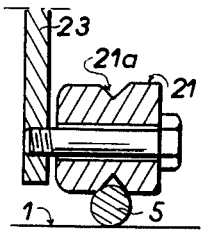
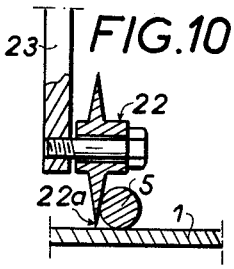
FIG.10

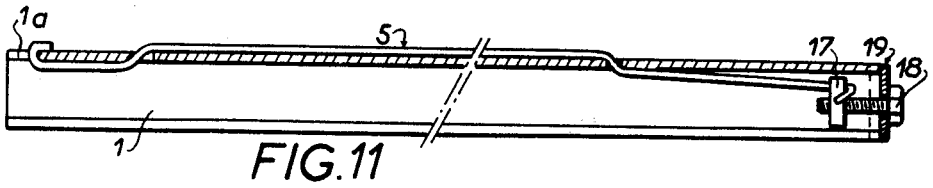
FIG.11
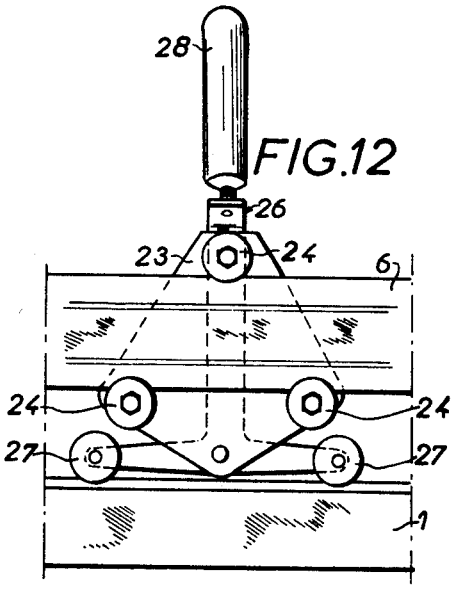
FIG.12
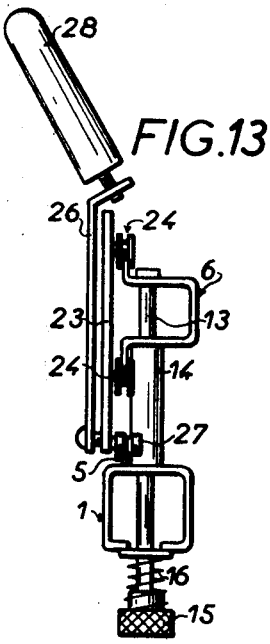
FIG.13
FIG.14
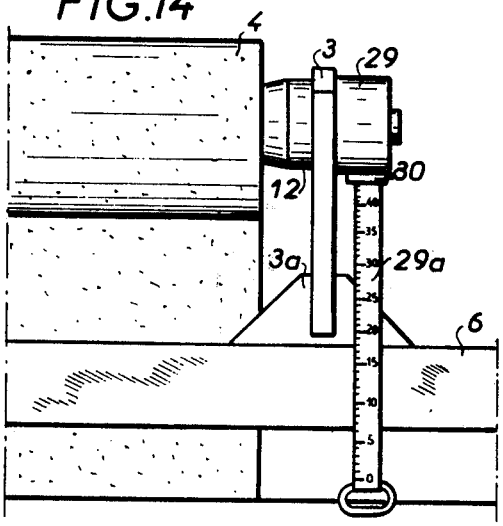

APPARATUS FOR CUTTING SHEET MATERIAL

BACKGROUND a. Field of the Invention

The invention relates to apparatus for cutting sheet material such as paper, padding, fibre, plastic, or the like, on a roll or not.

b. Prior Art

Numerous devices are known for cutting bands of material of small thickness from rolls thereof mounted on axle supports. These include scissors, shears, clippers, knives, razor blades, wheel cutters, and the like employed alone or mounted in a guide and manipulating assembly.

Such devices are especially adapted for cutting certain materials, such as, paper, padding, fabric, plastic sheeting, aluminum foil and the like. Most of them require substantial amounts of materials to be efficient and therefore are objectionable, or, in contrast, their simplicity does not provide sufficient guarantee of efficiency and of output.

These problems are principally found in the case of cutting materials of large width where conventional means such as scissors, razor blades, knives etc. do not permit obtaining a straight cut and high output. With regard to wheel cutters or blades carried and guided on the supply apparatus, they do not furnish a clean and straight cut in the sense that the cut material progressively hangs down in proportion to the length of cut and causes raising of the remaining material to be cut whereby the line of cut becomes curved at its end. Other cutting arrangements produce a pressing down of the material during the advance of the tool.

SUMMARY OF THE INVENTION

An object of the invention is to provide a cutting apparatus of the above class which is simple and assures a straight, clean cut of material whatever its length.

Such cutting apparatus is adapted for cutting conventional sheet material such as, paper, padding, fabric, plastic, aluminum foil, etc., either with the same tool or by simple modification.

The cutting apparatus of the invention is notable in that it comprises two distinct members adapted to effect a complete or partial cut which is straight and clean in sheet material which is unwound from a roll and passes between the members. One member is a fixed cutting member carried on a wall mount or adapted for resting on legs, and the other is a movable cutting member riding on or sliding on the fixed member over its entire length, the movable cutting member being guidably and slidably supported on a rail parallel to the fixed member.

The apparatus of the invention contemplates an embodiment wherein the movable cutting member is carried on a support whose form and material is selected to assure its controlled, slidable guiding directly on the fixed cutting member or on a profile member carrying the same.

BRIEF DESCRIPTION OF THE DRAWING

FIG. 5 is a sectional view showing a slidably adjustable assembly of the roll carrier and the support, FIG. 6 is a sectional view taken on line 6–6 in FIG. 5, FIG. 7 is a plan view showing the guide arrangement of the movable cutting member, FIG. 8 is a sectional view, on enlarged scale, taken along line 8–8 in FIG. 7, FIGS. 9 and 10 are sectional views of modifications of fixed cutting members, FIG. 11 is a sectional view showing the positioning and attachment of the fixed cutting member, FIG. 12 shows a modification for the movable cutting member, FIG. 13 is a side elevational view of the arrangement in FIG. 12, FIG. 14 is a plan view showing a portion of the apparatus with a system for measuring the length of material to be cut.

DETAILED DESCRIPTION

Figure 1:
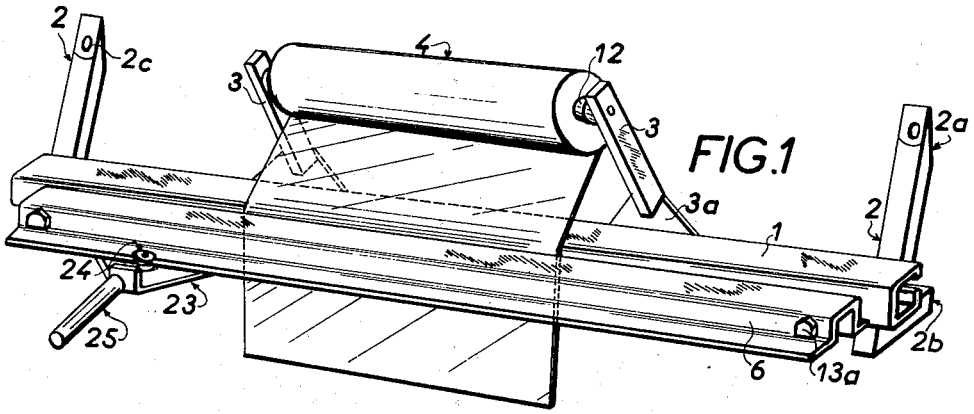
FIG. 1 is a perspective view of the apparatus according to the invention.
Figure 3:
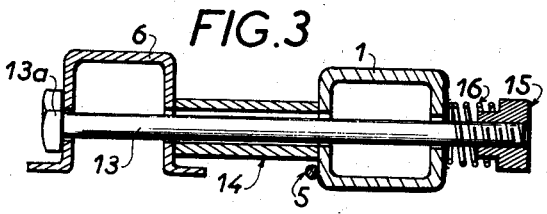
FIG. 3 is a sectional view showing the assembly of the support of the fixed cutting member and the guide rail.

Although the invention will be described in detail hereafter with reference to specific embodiments thereof, this is solely by way of example and without limitation.

For example, the apparatus has been illustrated in a horizontal disposition adapted for mounting on a vertical surface, but is is within the framework of the invention to employ other support means such as legs, or means attaching the apparatus to a vertical wall etc.

Referring to the drawing, therein is seen an elongated profiled member 1 connected at each of its extremities to a detachable wall mount 2. Arms 3 are slidably mounted on member 1 and carry a roll of material 4 which is to be fed and cut.

Member 1 also carries a fixed cutting member 5 as well as a rail 6 which extends parallel to member 1 and guidably support a movable cutting member. The rail 6 is attached at its ends to member 1.

Figure 2:
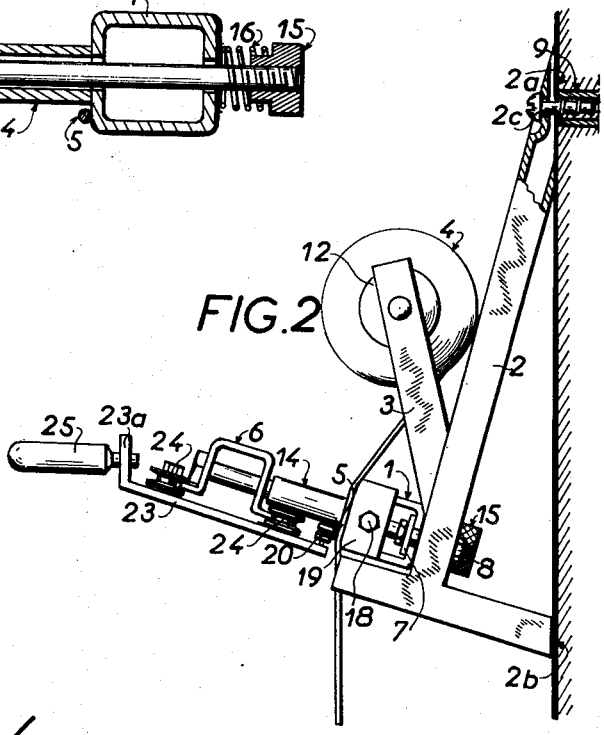
FIG. 2 is a side elevational view thereof, partly broken away.
Figure 4:
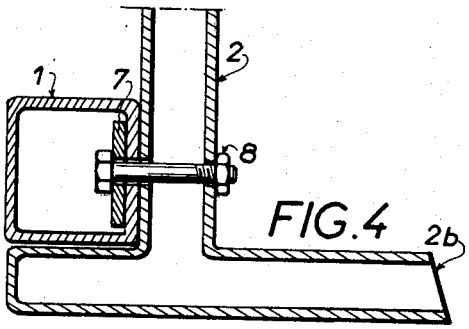
FIG. 4 is a sectional view showing the assembly of the support with the wall mounts.

The member 1 is preferably of rectangular or square section and is longitudinally open at the rear, i.e. at the side facing the mounts 2, the member 1 being fixed at the rear thereof to the mounts by means of a plate 7 and a bolt 8 (FIG. 4). Each mount 2 has the general shape of a T (FIG. 2) with its extremities 2*a*, 2*b* inclined in a common plane for support in angulated position against the wall as shown in FIG. 2. The upper extremity 2*a* is provided with an orifice 2*c* for passage of an attachment member 9 into the wall as shown in dotted outline in FIG. 2.

The arms 3 are mounted on member 1 by means of a slidable plate 10 engaged within the profile of member 1, the plate 10 having tapped holes for receiving a respective adjustment and locking screw 11 for each arm 3. Each screw 11 is loosely mounted in a respective flange 3*a* of the associated arm 3, the flange having lateral edges with folded portions 3*b* positioned in the opening in profiled member 1. A conical stub shaft 12 is supported for free rotation or not at the upper end of each shaft for engagement in the middle of the roll 4 as seen in FIG. 1.

The member 1 has holes near its lateral extremities and bolts 13 extend through the member 1 and the rail 6, the head 13*a* of the bolt 13 bearing against the outer face of rail 6. A sleeve 14 surrounds the bolt between rail 6 and member 1, and a nut 15, which is knurled, is threaded on bolt 13 and effects adjustable locking of the assembly through the intermediary of a spring 16 interposed between the nut 15 and member 1.

The member 1 carries the fixed cutting member 5 which is in the form of a piano wire extending parallel to member 1. The wire 5 is hooked at one extremity of a groove 1*a* in member 1 and it extends a short distance into the interior of member 1 and then passes externally thereof and returns into the interior of member 1 near the other extremity thereof. Thereat wire 5 is secured to a nut 17 which is adjustable in translation along screw 18 bearing against a plate 19 at the end of member 1 as shown in FIG. 11.

Movable cutting member can be embodied in many different ways and three embodiments are described hereafter by way of non-limitative example.

Referring to FIG. 8, therein are seen two roller sections 20 supported for free rotation on a support 23 guided on rail 6 in manner to be explained more fully later.

The roller sections straddle the piano wire and bear against it by adjusting the distance between the member 1 and the rail 6.

Commercially available roller sections 20 generally have edge faces which are joined to the cylindrical roller surfaces by a small rounded chamfer which in certain cases, for example, in cutting padding is sufficient to effect a clean cut through almost the complete thickness while leaving a thin skin which is easily torn by hand. This permits a straight line cut, since the padding, not being completely cut, does not hang or freely depend during advancement of the roller sections, thus avoiding the raising of the padding at the side remaining to be cut.

To facilitate the clean cut of other similar materials such as paper, aluminum foil and the like, there is provided a straight chamfer on the roller section forming a sharp apex at the side of the cut to more intensely cut the material.

In another embodiment illustrated in FIG. 9, the roller sections 20 are replaced by a single roller 21 having a central groove 21*a* straddling the piano wire with a sharp cutting edge at the side of the cut and a chamfer at the other side.

The roller section can be replaced by a cutting wheel 22 as seen in FIG. 10 whose cutting edge 22*a* runs along the piano wire which is thereby more rigidly guided over its length. This arrangement is adapted for cutting fabric, thick plastic sheets and other similar materials. Here, the cut is clean, the cut piece hanging down; however, the flexibility of the material causes it to rest on the member 1 preventing the raising of the non-cut section.

The roller sections 20, roller 21 or wheel 22 (serving as movable cutting members) are supported for free rotation on support 23 which passes under rail 6 and is guided thereon by means of wheels 24 mounted on support 23 and rollable on rail 6. The wheels are arranged at the apices of a triangle, i.e. a central wheel on one side of the rail and two lateral wheels on the other side of the rail. The rail itself is, for example, of U-shaped profile with bent legs forming the rails on which the wheels roll.

It is notable that between the two lateral wheels and the movable cutter member, the support 23 forms two oppositely inclined faces tending to push back the material to be cut at the time when the support makes contact with it. This causes the material to be flat against member 1 which faciliatates the cutting operation.

The extremity of the support 23 proximate the central wheel is upwardly bent and receives by threaded attachment, or the like, a manipulating handle 25 extending substantially horizontally.

In the case where the material to be cut requires a pressure force from the movable cutting member against the fixed cutting member in order to effect a satisfactory cut, the modified embodiment of the movable cutting member as shown in FIGS. 12 and 13 is employed. Therein the movable cutting member comprises a lever 26 of T-shaped mounted for free pivotal movement on support 23 at the center of the transverse branch of the T corresponding to the location of the movable member in the previously described embodiments thereof.

At each extremity of the transverse branch of the T, there are mounted for free rotation movable cutting members 27 (cutting wheel, roller sections, roller) which straddle the fixed cutting member 5. The position of the axis of rotation of lever 26 and the axes of rotation of the movable cutting members is carefully adjusted to leave a small play between these members and the piano wire to permit a small rocking movement of the lever and consequent pressure between the piano wire and the movable cutting members through the intermediary of a handle 28 fixed to the longitudinal branch of lever 26.

The piano wire is not the only embodiment of the fixed cutting member and it could be replaced by a bar of angle section (square, rhomboidal, or any selected angle) presenting an edge for contact with the movable cutting member at any suitable location on member 1. The member 1 could itself be formed directly with such edge constituting the fixed cutting member.

there is additionally provided a system for measuring the length of the material which is fed and cut. A number of suitable constructions include direct reading of length on a dial based on the number of turns of roller 4; reference marks on the vertical surface for the support and attachment of the apparatus with or without graduations over a certain length. A particular construction is illustrated in FIG. 14 wherein a measuring device 29 having a tape 29*a* with an automatic winding mechanism is carried on one of the arms 3 of the roller support. Care is taken to arrest the rewinding, for example, by means of abutment 30 fixed to the tape to allow the end of the tape to project a sufficient length for easy grasp thereof simultaneously with the material. The tape can be of the order of 1 or 2 meters in length depending on the maximum length of material to be cut.

Figure 15:
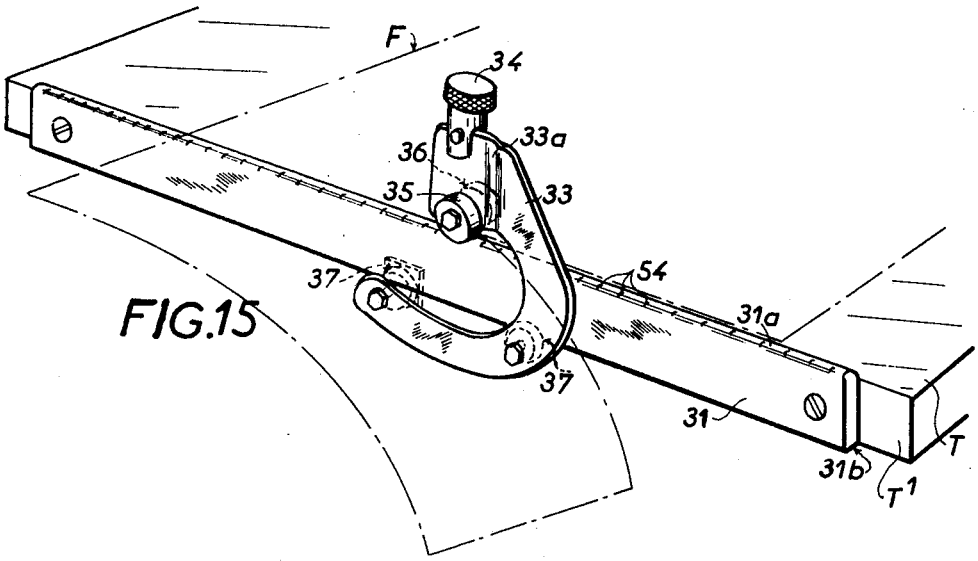
FIG. 15 is a perspective view of another embodiment according to the invention.
Figure 16:
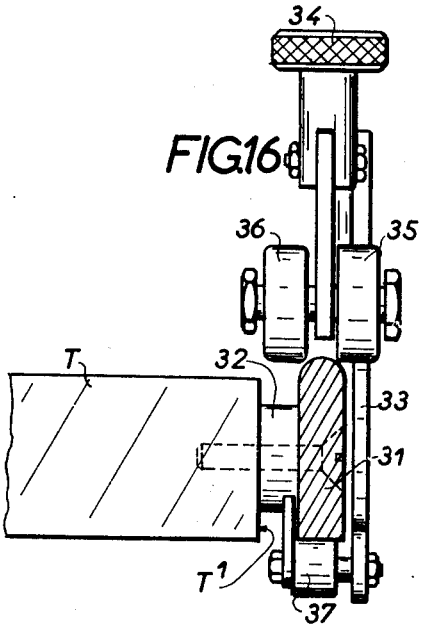
FIG. 16 is a side view of the embodiment in FIG. 15 with the fixed cutting member in section.
Figure 17:
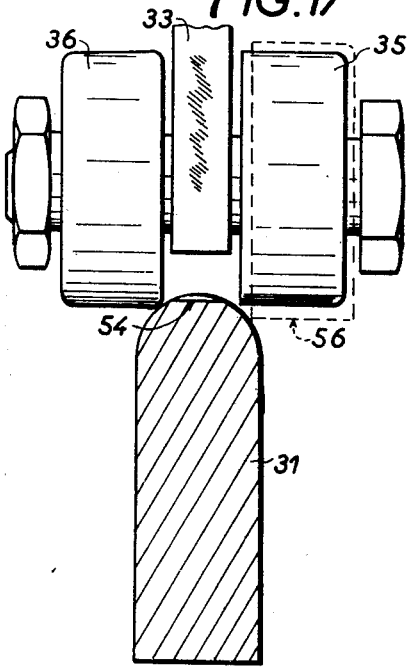
FIG. 17 shows on enlarged scale, the movable cutting member and the fixed cutting member.

In the embodiment of FIGS. 15–17, the fixed cutting member is in the form of a steel bar 31 of high strength which has been cold worked totally or in part, the bar being of generally rectangular cross-section with a rounded, convex upper surface 31*a* constituting the rolling surface for the movable cutting member.

The bar 31 is fixed to flange T1 which has a work surface T on which rests the sheet material F to be cut or a section unwound from the roller.

The bar 31 can be directly fixed to flange T1 if its small sides extend a substantial distance above and below the work surface, or it can be connected through the intermediary of spacers 32 if the bar has a height substantially equal to the thickness of the work surface in order to separate the movable cutting member and its guide means from the work surface and allow its free travel on the bar.

The movable cutting member comprises a support 33 of spring steel in the form of a C with an integral or attached manipulation member, such as knob 34, at its upper surface, and cutting members in the form of two rings or rollers 35, 36 mounted for free rotation on opposite sides of the upper portion of support 33 to bear rollably on the rounded surface 31*a* of the bar as seen in FIGS. 15–17.

The support 33 is offset at 33*a* to extend adjacent the bar and the support carries freely rotatable rollers 37 at its lower end which rollably bear against the lower surface 31*b* of the bar, the rollers 37 and rollers 35, 36 being arranged with their axes at the apices of a triangle.

Thus realized, the movable cutting member, due to the form of the support, its material, and the position of the rollers, is assured of permanent contact with the bar under the elasticity of the support.

Figure 18:
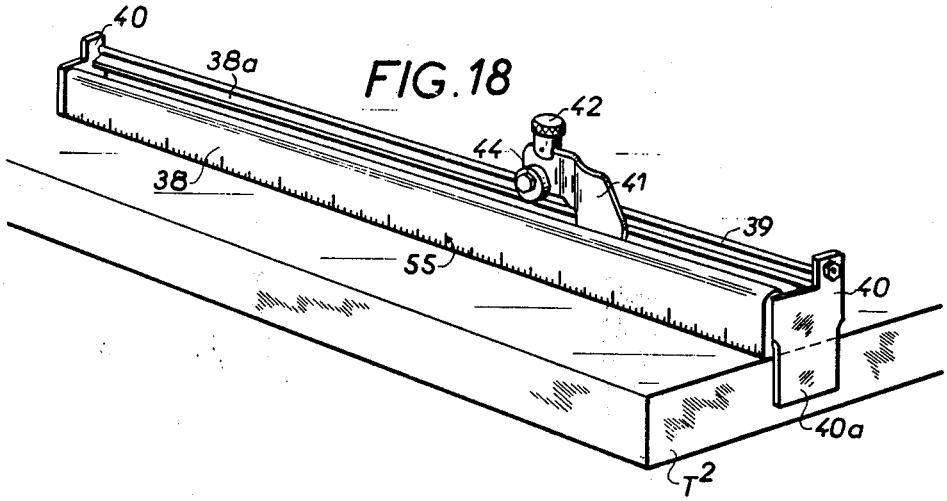
FIG. 18 is a perspective view of another embodiment according to the invention.
Figure 19:
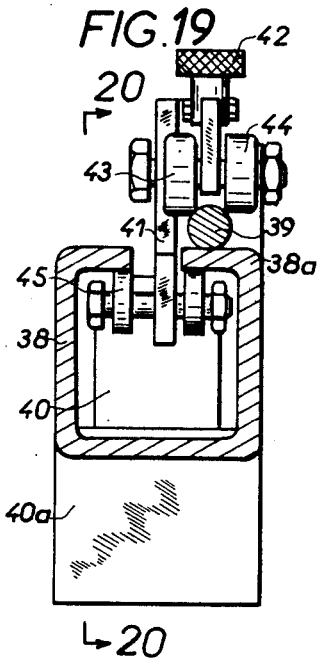
FIG. 19 is a side view of the embodiment in FIG. 18 with the fixed cutting member and the guide means for the movable cutting member in section.
Figure 20:
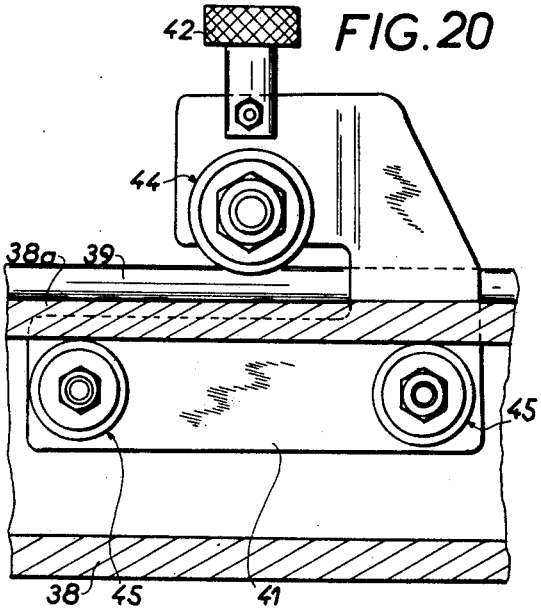
FIG. 20 is a sectional view taken on line 20–20 in FIG. 19.

In the embodiment illustrated in FIGS. 18–20 the apparatus comprises a profiled member 38 of U-shaped section which can directly constitute the fixed cutting member, for example, at bent ledge 38*a* at the top of one upright arm of the U-shaped section. Preferably, the fixed cutting member is in the form of a piano wire 39 fixed on the ledge or a hardened metallic filament adjustably secured at its ends to end plates 40, one of which is fixed and the other detachable.

The movable cutting member comprises, as before, a C-shaped member 41 with a manipulating element 42 at its top, and two cutting wheels 43, 44 mounted for free rotation and bearing on piano wire 39. At the lower portion of the bent section 41 which enters into the interior of the U-shaped member, the support carries freely rotatable rollers 45 which rollably bear against the lower surfaces of bent ledges 38*a* on opposite sides of the opening in the U-shaped member.

As before, the support thus realized, allows elastic bearing of the movable cutting member on the fixed cutting member.

There is provided on one of the end plates 40 a projection 40*a* bearing against edge T2 of the work surface in order to constitute a retaining abutment for the apparatus at the side from which the movable cutting member travels during the cutting stroke, thereby facilitating the operation and preventing lateral shift.

Figure 21:
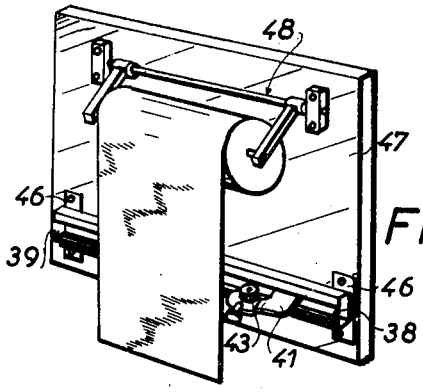
FIG. 21 is a perspective view of the embodiment of FIG. 18 arranged beneath a distributor for a roll of material.

The embodiment of FIGS. 18–20 can be used in other ways, for example, as shown in FIG. 21 against a wall. Therein the U-shaped member 38 is fixed at its ends, either directly at the base of the U-shaped member, or by ears 46 connected to the base. The assembly is then fixed either directly on the vertical surface of a wall below a distributor of rolled material or on a plate 47 together with the distributor as shown in FIG. 21.

Figure 22:
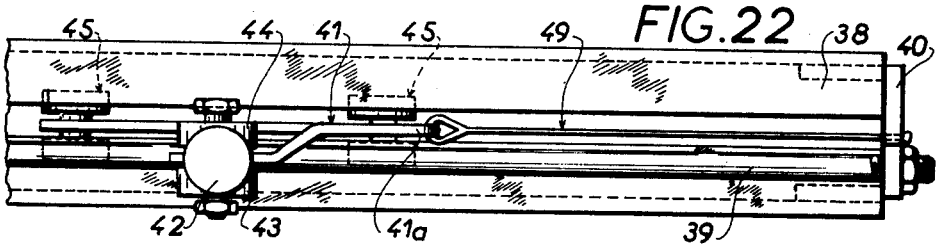
FIG. 22 is a top plan view of a portion of the embodiment of FIG. 18 showing a modified form of mounting.
Figure 23:
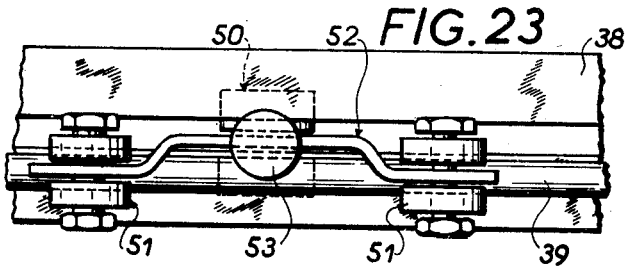
FIG. 23 is a top plan view for an arrangement of a modified support for two movable cutting members.

Variations of the apparatus are shown in FIGS. 22 and 23.

In FIG. 22, there is shown a support 41 of C-shape, as before, with a projection 41*a* in its central curved portion to which is attached an elastic recall element 49 of rubber or plastic which in turn is connected at its other end to the end plate 40 away from which the movable cutting member travels in the course of a cutting operation. In this way, the movable cutting member will automatically be returned to its starting position after the cutting operation by simple release of the movable cutting member.

It is evident that such arrangement is not only applicable to the previous embodiments in FIGS. 15 and 21 but to the other embodiments as well.

In FIG. 23, the movable cutting member has a single train of rollers 50 rolling under the ledges of the profiled member and two pairs of cutting rollers 51 in triangular disposition with rollers 50 and serving to cut the material in both strokes of the movable cutting member thereby reducing the handling especially when cutting large widths of material. For this purpose, the support 52 is still of C-shape but is inverted, the manipulation member 53 still being at the top of the support.

It is to be understood that this arrangement is also applicable to previously described embodiments especially those in FIGS. 15 and 18.

In fact, in order to avoid all sliding of the material during the cutting operation, notably for fabric, all or a part of the length of the bar 31 or the piano wire 39 can be provided with holding means 54 in the form of slots or grooves, or points or embossings, these being disposed at the curved surface between the cutting edges of the movable cutting member.

Furthermore, on the face of the bar or the profiled member a graduated scale 55 can be placed as shown in FIG. 18 to permit exact measurement of the depth of a limited cut.

The bar and the profiled member can also have a predetermined length measurement thereon either by their total length or by a given length between two conspicuous points thereon and corresponding to standard sizes commonly employed or appropriate to a particular use.

Additionally, for cutting material of substantial thickness such as velvet, or other heavy clothing material, it is noticed that the roller situated opposite the operative cutting roller has a tendency to mark the material which shows up as a slit adjacent the cut edge. In order to avoid this disadvantage, there is provided a roller 56 (shown in dotted outline in FIG. 17) of greater diameter than its opposing roller, therefore contacting the material and preventing the other from penetrating into the material.

In order to realize an arrangement of greater size to cut great lengths or widths of material of large thickness (velvet), there can be employed control means for a drive for the movable cutting member in order to operate this member without the use of physical force. Such means can be of any suitable known type such as a transmission with belts and pulleys, toothed wheels and chain drive controlled by a crank or by a suitable motor.

What is claimed is:

1. Apparatus for cutting band materials comprising means for supporting, in free rotation, a length of said material, fixed cutting means, movable cutting means slidably guided with respect to the fixed cutting means, support means for said fixed and movable cutting means, said fixed cutting means being constituted by a longitudinal profiled member fixed to said support means and having a rounded convex section for contact with the movable cutting means, said movable cutting means being constituted by at least one roller element having a sharp edge engaging the fixed cutting means to cut the band material placed between the fixed and movable cutting means.

2. Apparatus as claimed in claim 1 wherein said fixed cutting means is a metallic wire of circular section secured in tension on said support means.

3. Apparatus as claimed in claim 2 wherein said metallic wire has one extremity mounted on said support measure and another extremity attached to said support means for adjustment of the tension in the metallic wire, said metallic wire extending on said support means over its greater length and penetrating into said support means in proximity to its extremities.

4. Apparatus as claimed in claim 1 wherein said fixed cutting means is constituted directly by a rounded projection of the support means.

5. Apparatus as claimed in claim 1 wherein said fixed cutting means is constituted by a metallic bar fixed to the support means and having an upper face, for contact with the movable cutting means, which is semicircular in section.

6. Apparatus as claimed in claim 1 wherein said movable cutting means comprises two rollers one of which has a cutting edge in contact with the fixed cutting means, said roller with the cutting edge having a diameter at least as great as the other roller.

7. Apparatus as claimed in claim 1 wherein the movable cutting means is constituted by a roller provided with a median groove forming on one side thereof a cutting edge in contact with the fixed cutting means, said side having the cutting edge being at least as great in diameter as the other side of the groove.

8. Apparatus as claimed in claim 7 wherein said movable cutting means further comprises a base member displaceable on said support means, said roller being rotatably mounted on said base member, three guide wheels rotatably mounted on said base member at the corners of a triangle, said guide wheels being guidably mounted in straddling relation on said support means, and a manipulating handle on said base member.

9. Apparatus as claimed in claim 1 wherein said support means comprises a guide rail for said movable cutting means, a hollow shaped bar, and means securing the rail to the hollow bar in adjusted, spaced relation parallel to one another, the latter said means comprising two bolts at the respective extremities of the rail and bar, speacer sleeves on said bolts disposed between the rail and bar, an adjustment nut threaded on each bolt to lock the rail and bar in assembled relation, and a spring between said nut and the bar for effecting adjustment of parallelism between the rail and bar.

10. Apparatus as claimed in claim 1 wherein said support means comprises a hollow profiled element having an upper face with an opening therein, said fixed cutting means being mounted on said upper face at one side of said opening, said movable cutting means including a base member, guide wheels on said base member, and a cutting member on said base member, said base member passing in said opening with said guidewheels rolling internally in said profiled element and said cutting member rolling on the fixed cutting means.

11. Apparatus as claimed in claim 10 wherein said support means is adapted for being placed on a table having a lateral edge, said hollow profiled element having opposite ends, and projection means at one of said ends of said profiled element for laterally engaging the edge of said table to oppose displacement of the profiled element in the direction of travel of the movable cutting means during cutting of the band material.

12. Apparatus as claimed in claim 10 wherein said hollow profiled element has a predetermined length corresponding to a standard length in practice.

13. Apparatus as claimed in claim 10 wherein said hollow profiled element has graduations for measuring the depth of a partial cut in the band material.

14. Apparatus as claimed in claim 1 comprising elastic means connecting said movable cutting means to said support means for returning the movable cutting means to an initial position at one of the extremities of the longitudinal profiled member after displacement of the movable cutting means for a cutting operation.

15. Apparatus as claimed in claim 1 comprising means on at least a portion of the length of the rounded surface of the profile member for retaining the band material on said surface during a cutting operation.

* * * * *